US006136148A

United States Patent [19]

Koskinen et al.

[11] Patent Number: 6,136,148

[45] Date of Patent: Oct. 24, 2000

[54] METHOD FOR CLEANING FABRICS OF A PAPER MACHINE

[75] Inventors: Pekka Koskinen, Kotka; Timo Haverinen, Masku, both of Finland

[73] Assignee: EV Group Oy, Kotka, Finland

[21] Appl. No.: 08/875,286

[22] PCT Filed: Jan. 22, 1996

[86] PCT No.: PCT/FI96/00044

§ 371 Date: Oct. 14, 1997

§ 102(e) Date: Oct. 14, 1997

[87] PCT Pub. No.: WO96/23101

PCT Pub. Date: Aug. 1, 1996

[30] Foreign Application Priority Data

Jan. 23, 1995 [FI] Finland ..... 950281

[51] Int. Cl.[7] ..... D21F 1/32

[52] U.S. Cl. ..... 162/199; 162/274; 162/275

[58] Field of Search ..... 162/199, 272, 162/274–279; 134/15; 34/85

[56] References Cited

U.S. PATENT DOCUMENTS

| | | | |
|---|---|---|---|
| 3,347,740 | 10/1967 | Goumeniouk | 162/199 |
| 5,863,386 | 1/1999 | Vuorinen et al. | 162/199 |

FOREIGN PATENT DOCUMENTS

| | | |
|---|---|---|
| 0 024 205 A1 | 2/1981 | European Pat. Off. . |
| 79870 | 3/1983 | Finland . |
| 802545 | 7/1989 | Finland . |
| 924175 | 9/1992 | Finland . |
| 40 18 074 C2 | 12/1991 | Germany . |
| 1018367 | 1/1966 | United Kingdom . |
| WO 92/13132 | 8/1992 | WIPO . |

OTHER PUBLICATIONS

1993 Practical Aspects of Pressing and Drying Seminar, Course Notes pp. 1–16, M.M. Cutts: "Press and Dryer Fabric Cleaning and Moisture Profile Management".

*Primary Examiner*—Peter Chin
*Attorney, Agent, or Firm*—Kubovcik & Kubovcik

[57] ABSTRACT

A method and apparatus for cleaning a drying fabric of a paper machine. In the method a cleaning liquid is introduced into a gap (3) defined by the roll or cylinder (2) of a paper machine and a fabric (1) being fed onto the roll or cylinder. The cleaning liquid is pressed between the roll or cylinder (2) and the fabric (1) and is carried along with the fabric and is spread along the whole width of the fabric. The apparatus includes means for introducing and spreading the cleaning liquid into the gap between the roll and cylinder (2) and the drying fabric and, optionally, includes means (6) for collecting the cleaning liquid.

11 Claims, 3 Drawing Sheets

METHOD FOR CLEANING FABRICS OF A PAPER MACHINE

BACKGROUND OF THE INVENTION

The present invention is directed to a method of cleaning fabrics, particularly paper machine fabrics.

The present invention is also directed to an apparatus for cleaning fabrics, particularly paper machine fabrics.

Fouling of fabrics has been experienced to be a problem in present fast running paper machines and particularly in such machines which use fillers and/or recycled fibres. In addition, or alternatively to that, particularly the fast decreasing of permeability of the first drying fabrics or wires after the machine has been started is becoming more and more common, particularly in machines where so called suction rolls and web stabilizers are used for supporting the web in contact with the drying fabric. In such a case also dust and/or other particles in surrounding air and/or in the web is sucked through the fabric. Dust or other particles decrease rapidly the permeability of the fabric and thus, e.g. reduce the effect of the web stabilizing equipment, which may result in a need of decreasing the speed of the machine.

In presently used cleaning methods the cleaning of fabrics is typically accomplished by blowing pressurized air or cleaning liquid through the fabric with special nozzles, which are moved across the running direction of the fabric. In such a case, even if there are several nozzles adjacent to each other, a considerably long period of time is required for good cleaning results in order to have the whole fabric treated.

It is an intention of the present invention to provide a totally new method of cleaning of fabric, with which method shortcomings of the prior art are minimized.

It is also an intention of the present invention to provide a totally new apparatus for cleaning of fabric, with which method shortcomings of the prior art are avoided.

SUMMARY OF THE INVENTION

The solution according to the present invention has several considerable advantages compared to prior art systems. The method according to the present invention is very quick. The whole fabric may be cleaned over its whole area even during a short break. For example, when a machine speed is 1300 m/min and the fabric has a length of 45 m, the cleaning of the fabric takes place about 29 times during a one minute cleaning period. Thus the method of the present invention does not require long shut-down periods of the paper machine. Also, the cleaning is accomplished during normal running conditions, that is, normal operation speed.

BRIEF DESCRIPTION OF THE DRAWINGS

The invention will be explained in the following by means of preferred examples referring to the following figures, in which.

DESCRIPTION OF PREFERRED EMBODIMENTS

Figure 1:
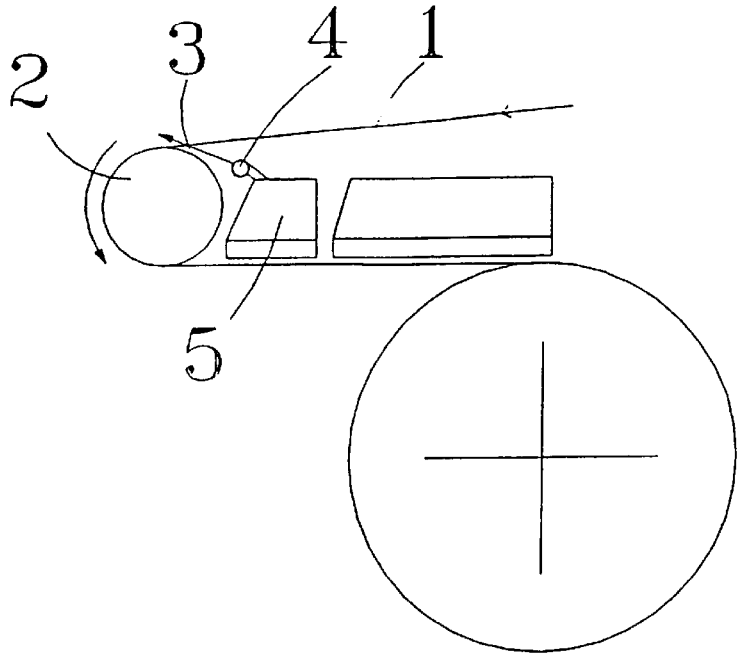
FIG. 1 depicts an exemplary embodiment according to the present invention.

In the case of FIG. 1 the fabric (1), such as a wire or felt of a paper machine has been arranged to run along the roll or cylinder (2). The gap (3) defined by the fabric (1) and the cylindric surface (of a cylinder of a roll) is referred to a nip. The nip is called as a closing nip, if the fabric (1) is coming into the gap, and respectively as an opening nip if the fabric (1) in leaving the gap. According to the invention liquid for cleaning the fabric is introduced into the closing nip (3), between the fabric (1) and roll (2). Thus the liquid is pressed between the roll (2) and the fabric (1) and further into the fabric (1) disengaging therefrom by an effect of, e.g., centrifugal force caused by the rotation of the roll (2). The liquid is thus carried along through the fabric. The fabric is cleaned of its whole width several times even during a period of one minute. In case the paper machine speed is 1300 m/min and the fabric has a length of 45 m, the cleaning of the fabric takes place about 29 times during a one minute cleaning action. Thus the cleaning of the fabric (1) according to the method of the present invention does not require long shut-down periods of the paper machine. The cleaning is preferably performed while the machine is running at its normal operation speed.

The device (4) for introducing and spreading the cleaning liquid is preferably arranged into the drying section of the paper machine, for example in connection with a web stabilizer (5) nearest to the press section, preferably into a closing nip of a leading roll at a press section side of the stabilizer (5). The device for introducing (4) and spreading the cleaning liquid comprises for example a duct means across the running direction of the fabric, in the wall of which openings or nozzles are arranged for introducing cleaning liquid between the fabric and the roll. In the Figures a presently preferred direction of sprayed cleaning liquid is illustrated by an arrow. Openings or nozzles are arranged in the duct means preferably equally spaced to provide substantially even introduction of the liquid over the whole width of the fabric.

Figure 2:
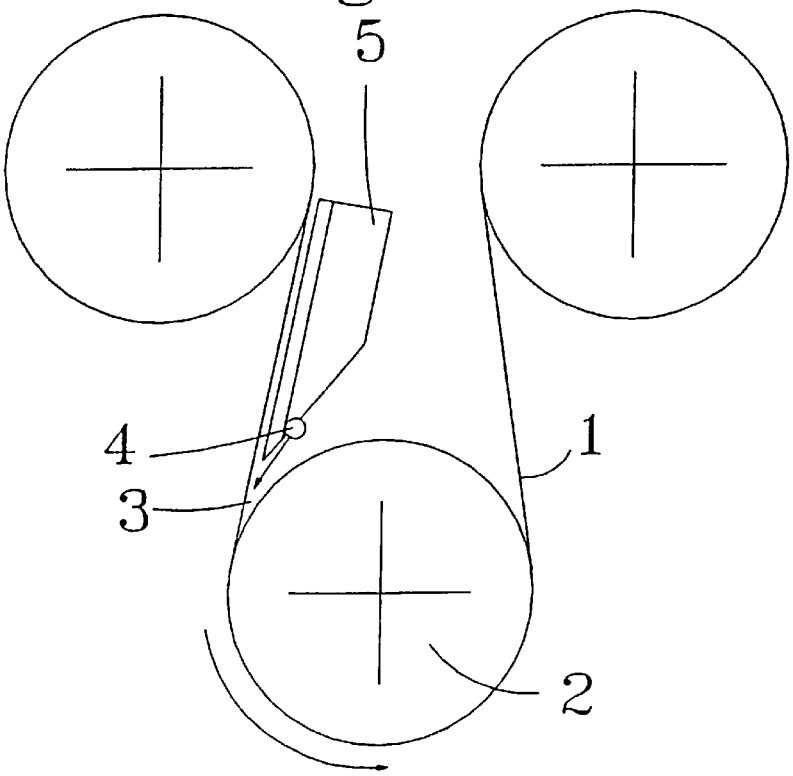
FIG. 2 depicts another exemplary embodiment according to the present invention.

The device for introducing and spreading the cleaning liquid (4) may be rigidly attached to a paper web stabilizer used at least in a part of the drying section of a paper machine as shown in FIGS. 1 and 2.

Figure 3:
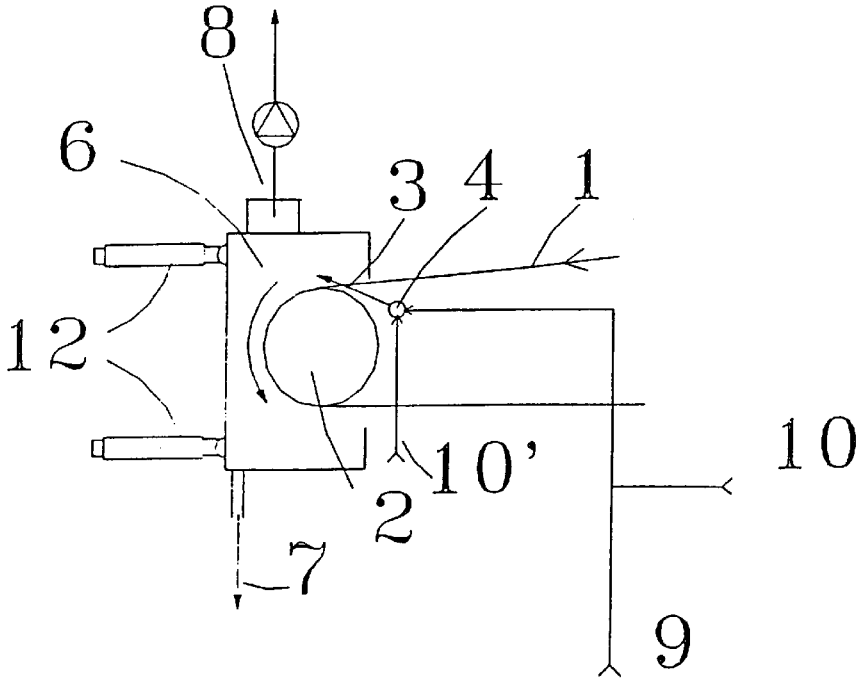
FIG. 3 depicts still another exemplary embodiment according to the present invention.

Means for collecting (6) the cleaning liquid may be arranged in connection with a roll or a cylinder, preferably on an opposite side of the fabric than the device (4) for introducing and spreading the cleaning liquid. Preferably the means for collecting (6) the cleaning liquid comprise a hood (6) provided with liquid (7) and gas (8) exhaust outlets. The hood (6) may be designed suitably for each individual application. It may be slightly different; e.g., in case the fabric is moving in the opposite direction of that shown in FIG. 3.

Presently it is considered advantageous to use hot water having a temperature between 40–100° C. as the cleaning liquid. It is also possible to use some suitable detergent or solvent in connection with or in addition to using hot water. The detergent or solvent may be introduced by the device for introducing and spreading the cleaning liquid provided with a detergent or solvent introduction inlet (10, 10') arranged, for example, directly on device (4) or to ductwork delivering the cleaning liquid (9).

The hood (6) is movably/rotatably installed, and preferably provided with means for moving (12) and/or rotating the hood (12') in order to facilitate the changing of fabric. The hood may also comprise means for introducing cleaning agent (13) inside the hood, which cleaning agent may be, for example, hot water or detergent or solvent.

Figure 4:
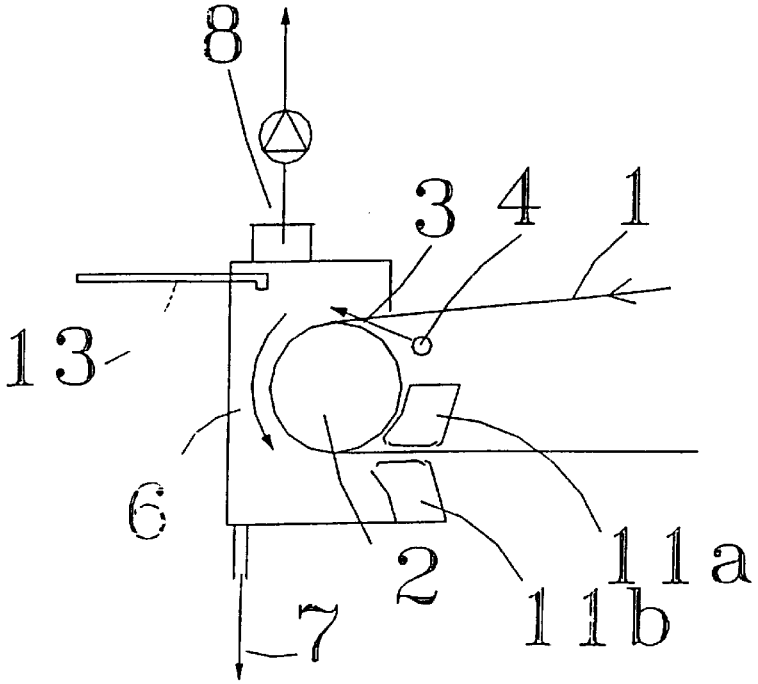
FIG. 4 depicts still another embodiment according to the present invention.

In FIG. 4 there is shown an embodiment where an air blowing box (11*a*) is provided adjacent to the opening nip of the roll or cylinder (2). There is also an air blowing box (11*b*) provided adjacent to the fabric on an opposite side to the upper blowing box (11*a*). The air blowing box (11*a*, 11*b*) is provided in operational connection with the fabric (1) leaving the opening nip of the roll or cylinder (2). The air blowing box forms over pressure between the fabric and the box surface which causes an air flow through the fabric expelling possible remaining cleaning liquid from the fabric. The blowing box preferably comprises so called over pressure foil nozzles. Blowing box (11*a*, 11*b*) is advantageous, for example, for the following reasons. It forms a considerably large over pressure area even through requiring only minimized amount of air due to its two narrow nozzles on both sides of the box. The embodiment of FIG. 4 is only exemplary and it is presently believed that it is an advantageous embodiment of the invention. However, it may be also possible to use only one of either the upper (11*a*) or lower (11*b*) blowing box if some specific situation so calls for.

Figure 5:
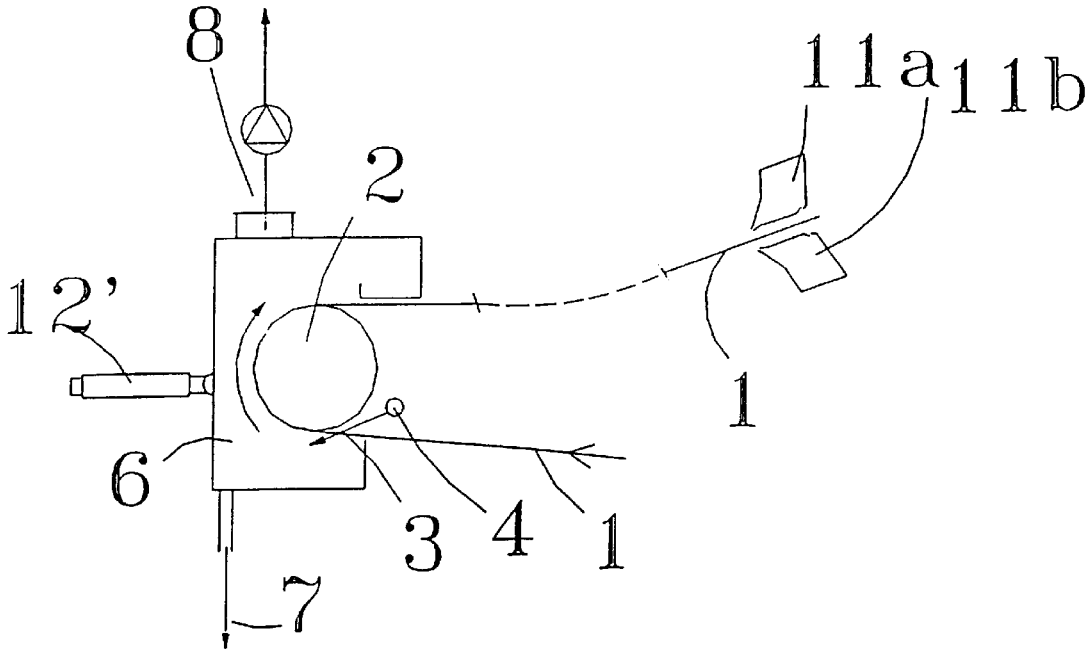
FIG. 5 depicts still another embodiment according to the present invention.

In FIG. 5 there is shown another embodiment similar to that of FIG. 4 but having the air blowing boxes (11*a*, 11*b*) provided a distance from the roll or cylinder (2), also the direction of movement of the fabric is opposite to that of FIG. 4. The dashed line between the roll or cylinder (2) and the air blowing boxes (11*a*, 11*b*) illustrates that there may even be some means, such as rolls or cylinders, for changing the moving direction of the fabric (1) between the roll or cylinder (2) and the air blowing boxes (11*a*, 11*b*). This embodiment may be useful, for example, if the space is for some reason limited for construction shown in FIG. 4. However, it may be also possible to use only one of either the upper (11*a*) or lower (11*b*) blowing box if some specific situation so calls for.

The air blowing box (11*a*, 11*b*) is provided with a nozzle arrangement including a nozzle or nozzles selected from a group of at least a so called over pressure foil nozzle and a slot nozzle. Thus the blowing box may comprise so called over pressure foil nozzles or a slot nozzle adjacent the roll or fabric surface blowing air against the direction of the movement of the roll or fabric surface. The air flow may also be directed perpendicularly to the fabric.

The blowing box (11*a*, 11*b*) is advantageous, for example, for the following reasons. It forms a considerably large over pressure area even through it requires only a minimized amount of air due to its considerably narrow nozzles.

The air used in the air blowing box may be hot and considerably dry air, thus providing also evaporation of the water in the fabric. The air may, for example, from an air source providing air for web stabilizers or web turning air device(s).

It is clear to a man skilled in the art that the invention is not limited to the described embodiments. The features described above may be, for example, combined differently according to requirement of each application. Thus it is clear that the scope of the present invention may vary within the accompanied patent claims.

What is claimed is:

1. A method of cleaning a drying wire in the drying section of a paper machine following the press section, comprising leading the drying wire (1) through at least one roll or cylinder (2) of the drying section of the paper machine;

introducing a cleaning liquid into a gap (3) defined by the drying wire (1) and the roll or the cylinder (2), in the direction of which gap (3) the drying wire (1) is moving pressing the cleaning liquid between the roll or cylinder (2) and the drying wire (1) so that it is caused to be carried along through the drying wire (1), and spreading the cleaning liquid along the whole width of the drying wire (1).

2. The method according to claim 1, wherein the cleaning liquid is spread substantially evenly over the whole width of the drying wire (1) and is disengaged from the fabric (1) by the rotation of the roll (2).

3. The method according to claim 1, wherein the cleaning liquid is spread with device (4), which is arranged in connection with a web stabilizer.

4. The method according to claim 1, wherein a device (4) for introducing and spreading the cleaning liquid is arranged into the drying section of the paper machine in connection with a web stabilizer (5) nearest to the press section.

5. The method according to claim 4, wherein the cleaning liquid is collected with means (6) for collecting the cleaning liquid.

6. The method according to claim 1, wherein hot water having a temperature between about 40–100° C. is used as the cleaning liquid.

7. The method according to claim 6, wherein a detergent or solvent is used in connection with or in addition to using hot water.

8. The method according to claim 7, wherein the detergent or solvent is introduced by the device (4) for introducing and spreading the cleaning liquid which is provided with a detergent or solvent introduction inlet (10, 10') arranged directly on the device (4).

9. The method according to claim 1, wherein at least one air blowing box (11*a*, 11*b*) is provided adjacent to the drying wire leaving the roll or cylinder 2, the method comprising the further steps of forming over pressure between the drying wire and the box surface by said air blowing box (11*a*, 11*b*), causing an air flow through the drying wire, and expelling any remaining cleaning liquid from the drying wire along with the air flow through the drying wire.

10. The method according to claim 1, wherein the air blowing box (11*a*, 11*b*) forms the over pressure by means of over pressure foil nozzles, a slot nozzle or a combination thereof, providing an air flow against the direction of the movement of the roll or drying wire surface.

11. The method according to claim 10 wherein the air flow is provided in a direction perpendicular to the drying wire.

* * * * *